US009868202B1

(12) United States Patent
Burcham et al.

(10) Patent No.: US 9,868,202 B1
(45) Date of Patent: Jan. 16, 2018

(54) SPRING LOADED IMPACT TOOL

(71) Applicants: Donald Burcham, Carlinville, IL (US); Gregory Burcham, Carlinville, IL (US)

(72) Inventors: Donald Burcham, Carlinville, IL (US); Gregory Burcham, Carlinville, IL (US)

( * ) Notice: Subject to any disclaimer, the term of this patent is extended or adjusted under 35 U.S.C. 154(b) by 259 days.

(21) Appl. No.: 14/842,186

(22) Filed: Sep. 1, 2015

(51) Int. Cl.
*B25G 1/01* (2006.01)

(52) U.S. Cl.
CPC ..... *B25G 1/01* (2013.01)

(58) Field of Classification Search
CPC ..... B27L 7/005; B25D 1/16; B25G 1/01
See application file for complete search history.

(56) References Cited

U.S. PATENT DOCUMENTS 3,377,052 A * 4/1968 Hagen ..... B25D 3/00 254/104
3,735,822 A * 5/1973 Deike ..... B25D 1/16 144/195.5
3,792,739 A * 2/1974 Deike ..... B25D 1/16 173/118
4,350,192 A * 9/1982 Dent ..... B27L 7/005 144/195.5
4,458,415 A * 7/1984 Maher ..... B25B 27/02 144/195.5
4,470,440 A 9/1984 Thor
5,097,912 A * 3/1992 Bowers ..... B25D 1/16 173/118
5,365,648 A * 11/1994 Fuga ..... B25B 27/02 29/254
5,370,192 A * 12/1994 Evinger ..... B25D 3/00 173/132
5,495,878 A * 3/1996 McKenen, Jr. ..... B27L 7/005 144/193.1
5,865,490 A 2/1999 Vowell
5,878,822 A * 3/1999 Roy ..... B25F 1/02 173/132
6,349,618 B1 2/2002 Lowther
6,533,004 B1 * 3/2003 Thor ..... B27L 7/06 144/195.5
6,631,668 B1 10/2003 Wilson
7,191,685 B2 * 3/2007 Lowther ..... B21D 1/06 81/27
7,320,490 B2 1/2008 Yakimchuk
8,276,683 B1 * 10/2012 Roy ..... B25D 1/16 173/126
9,198,337 B2 * 12/2015 Walsh ..... A01B 1/026
9,206,569 B1 * 12/2015 Roy ..... B25D 1/16
2014/0076595 A1 * 3/2014 Belsey ..... B25D 1/00 172/371
2015/0183104 A1 * 7/2015 Patterson ..... B25D 1/16 81/25

* cited by examiner

*Primary Examiner* — David B Thomas
(74) *Attorney, Agent, or Firm* — Kyle A. Fletcher, Esq.

(57) ABSTRACT

The spring loaded impact tool is a safety device designed for use with impact tools such as chisels, pry levers, hammers, shovels, scrapers, or tampers. Specifically, the spring loaded impact tool is an enhanced shaft that replaces the traditional shaft that is used as the handle in impact tools. The enhanced shaft further comprises a spring that provides the user greater control over the impact tool compared to the traditional shaft. The spring loaded impact tool comprises an enhanced shaft. The enhanced shaft further comprises an outer shaft, an inner shaft, a compression spring, and a threaded connection.

8 Claims, 4 Drawing Sheets

SPRING LOADED IMPACT TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of handlers with spring devices, more specifically, a spring loaded handle adapted for use with impact tools.

SUMMARY OF INVENTION

The spring loaded impact tool is a safety device designed for use with impact tools such as chisels, pry levers, hammers, shovels, scrapers, or tampers. Specifically, the spring loaded impact tool is an enhanced shaft that replaces the traditional shaft that is used as the handle in impact tools. The enhanced shaft further comprises a spring that provides the user greater control over the impact tool compared to the traditional shaft.

These together with additional objects, features and advantages of the spring loaded impact tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the spring loaded impact tool in detail, it is to be understood that the spring loaded impact tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the spring loaded impact tool.

It is therefore important that the claims be regarded as including such equivalent construction insofar as they do not depart from the spirit and scope of the spring loaded impact tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
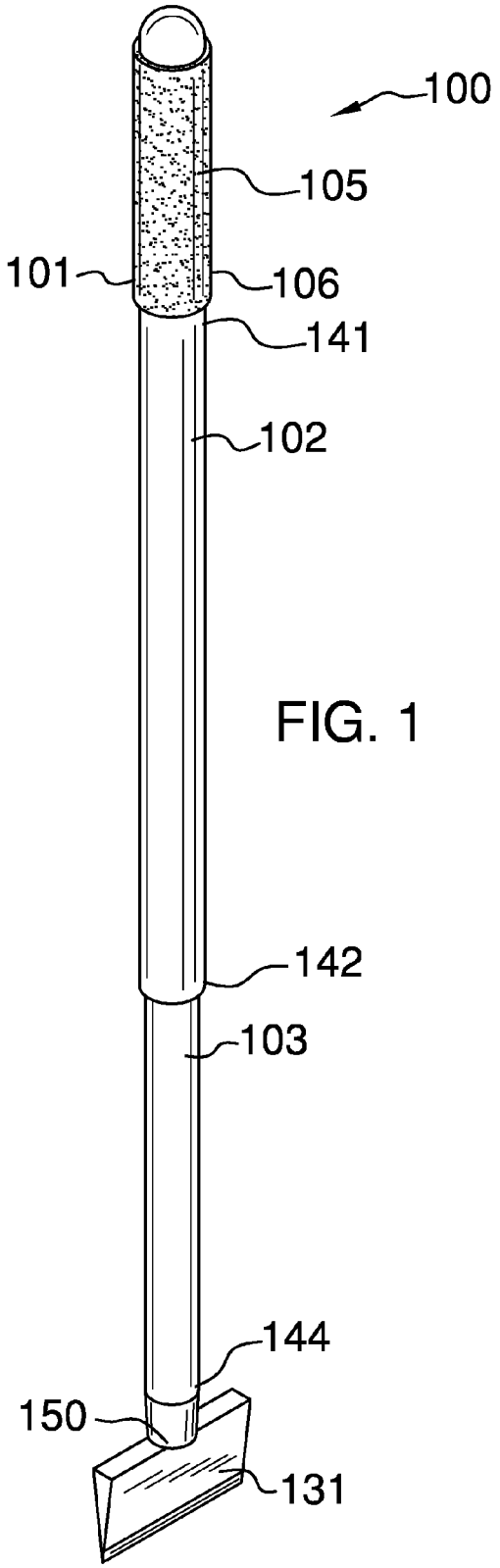
FIG. 1 is a perspective view of an embodiment of the disclosure.
Figure 2:
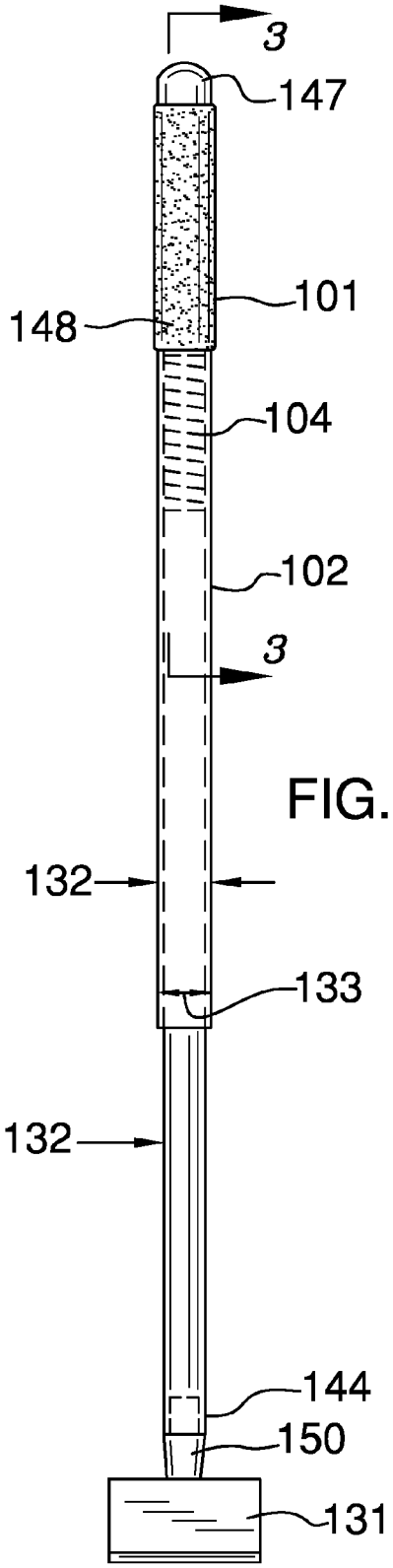
FIG. 2 is a front view of an embodiment of the disclosure.
Figure 3:
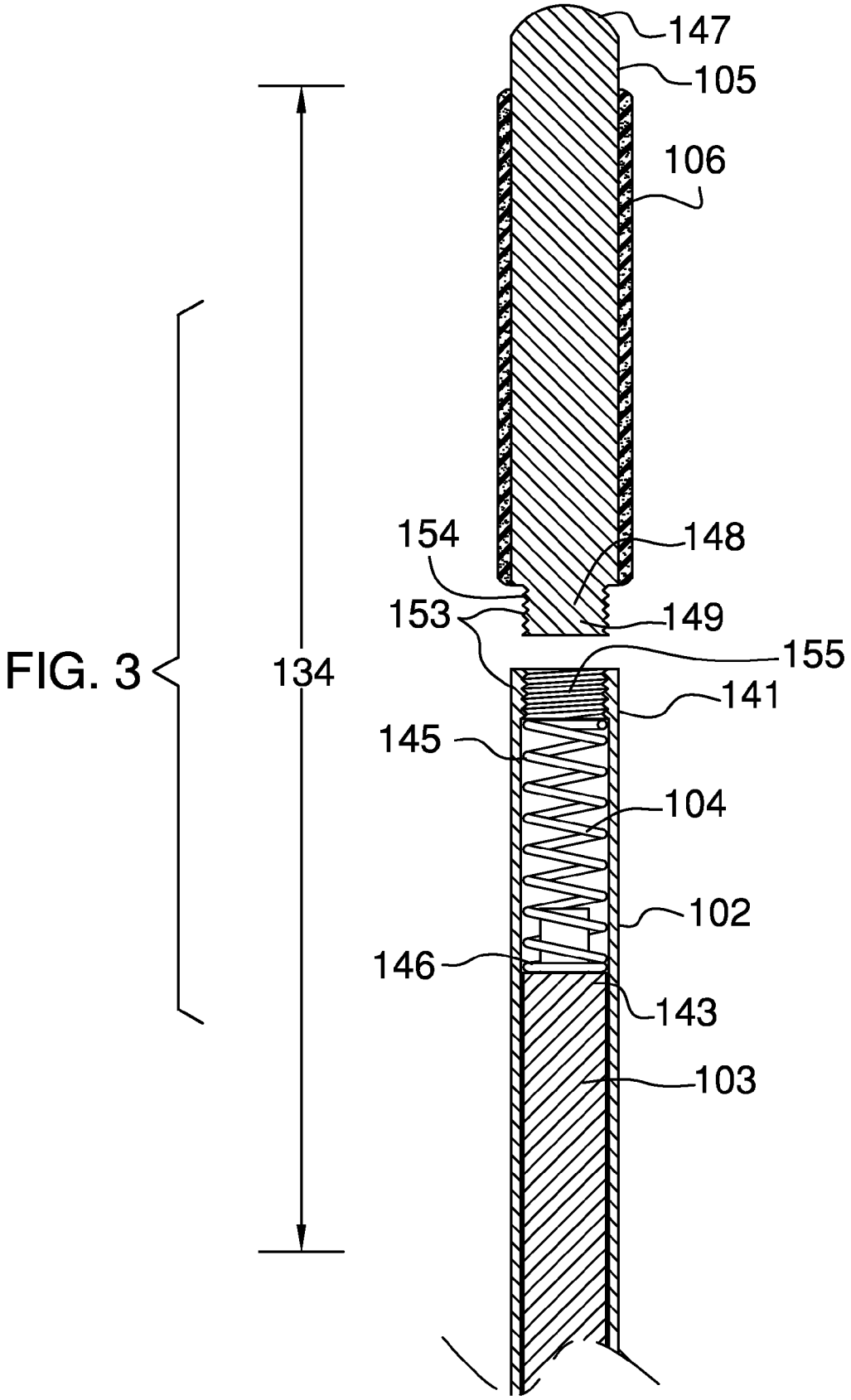
FIG. 3 is a cross-sectional view of an embodiment of the disclosure across 3-3.
Figure 4:
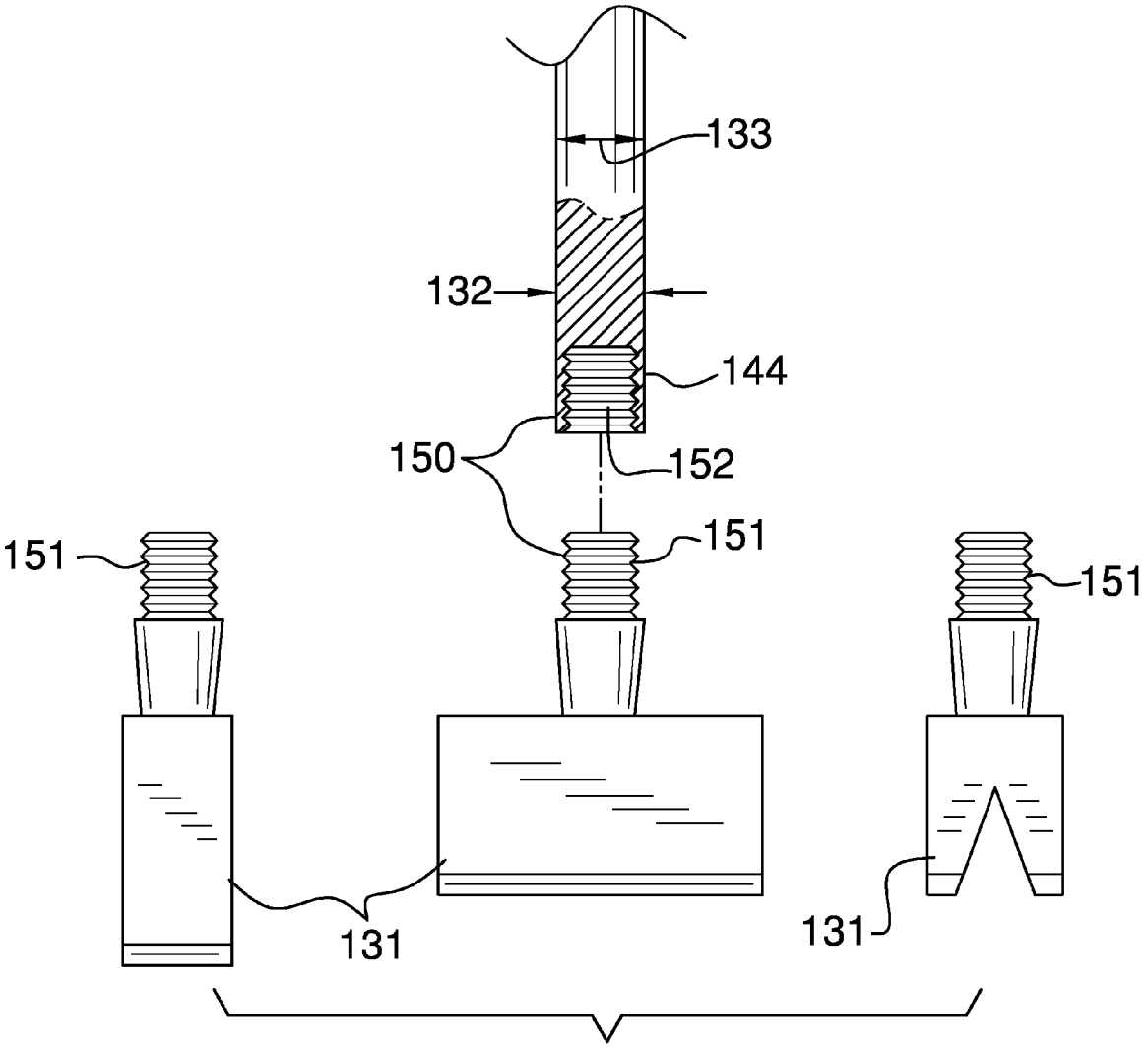
FIG. 4 is an exploded view of an embodiment of the disclosure.
Figure 5:
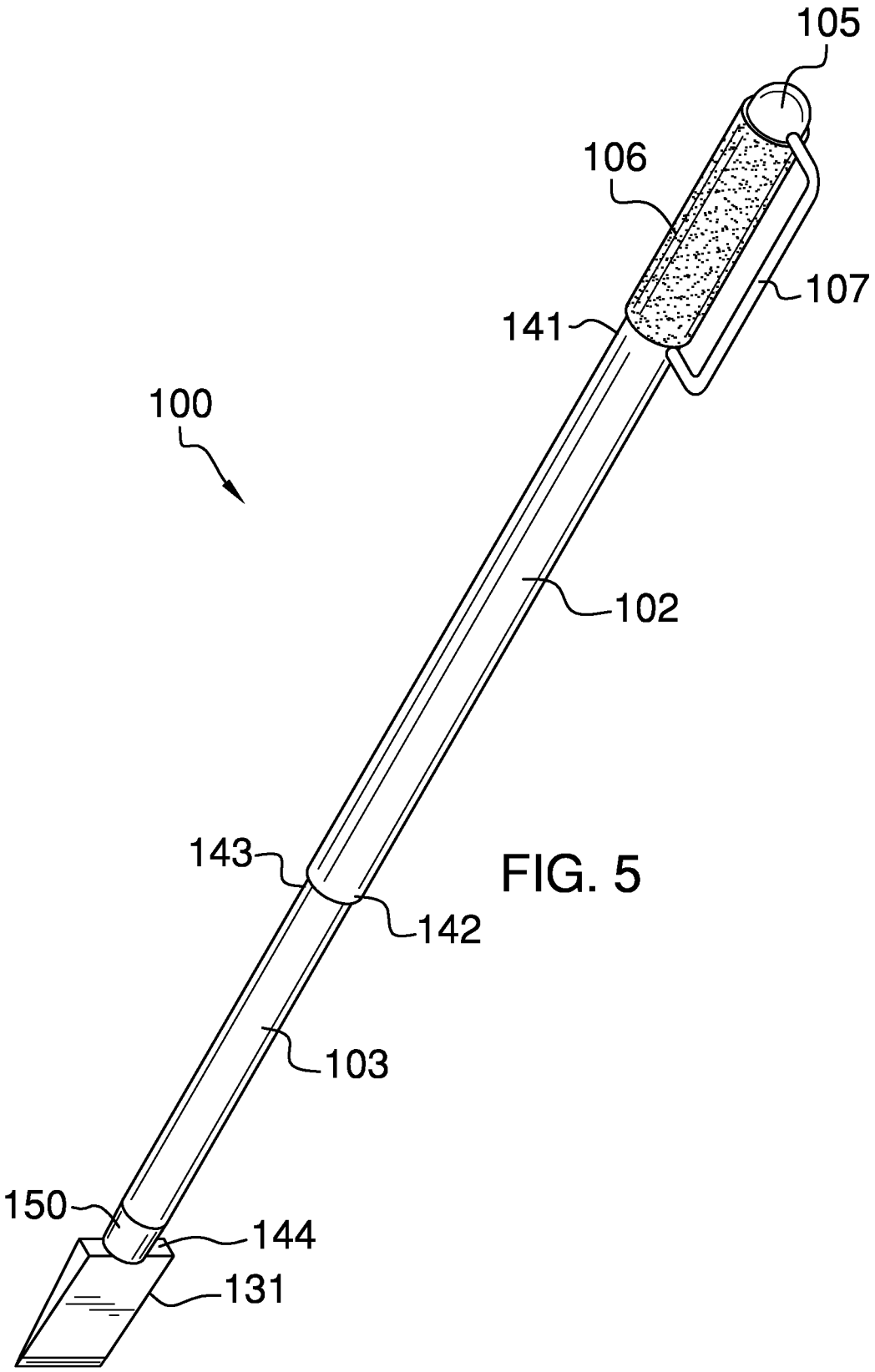
FIG. 5 is a perspective view of an alternate embodiment of the disclosure.

Detailed reference will now be made to a first potential embodiment of the disclosure, which is illustrated in FIGS. 1 through 5. The spring loaded impact tool 100 (hereinafter invention) comprises an enhanced shaft 101. The enhanced shaft 101 further comprises an outer shaft 102, an inner shaft 103, a compression spring 104, a handle 105, a grip 106, and a tenth threaded connection 150.

The outer shaft 102 is a hollow cylindrical device that is further defined with a first end 141 and a second end 142. The first end 141 and the second end 142 are open. The inner shaft 103 is a solid cylindrical device that is further defined with a third end 143 and a fourth end 144. The compression spring 104 is a heavy duty helical coil spring. The compression spring 104 is further defined with a fifth end 145 and a sixth end 146. The handle 105 is a cylindrical device. The handle 105 is further defined with a seventh end 147 and an eighth end 148.

The outer diameter 132 of the inner shaft 103 is sized so that it will fit inside the inner diameter 133 of the outer shaft 102 at the second end 142. The outer diameter 132 of the compression spring 104 is less than the inner diameter 133 of the outer shaft 102. The handle 105 has fitted on it a ninth cylindrical plug 149 that projects perpendicularly away from the eighth end 148 of the handle 105. The outer diameter 132 of the ninth cylindrical plug 149 is sized to fit within the inner diameter 133 of the outer shaft 102.

The fourth end 144 of the inner shaft 103 further comprises a tenth threaded connection 150. The tenth threaded connection 150 further comprises a twelfth interior screw thread 152. Specifically, the fourth end 144 of the inner shaft 103 is formed with a cavity that has the twelfth interior screw thread 152 formed with the cavity. The tool 131 that the enhanced shaft 101 is to be connected to has associated with it an eleventh exterior screw thread 151. The twelfth interior screw thread 152 is adapted to connect to the eleventh exterior screw thread 151 thereby forming the tenth threaded connection 150 between the tool 131 and the enhanced shaft 101.

To assemble the enhanced shaft 101, the third end 143 of the inner shaft 103 is inserted into the second end 142 of the outer shaft 102. A thirteenth threaded connection 153 is used to join the handle 105 and the first end 141 of the outer shaft 102. The interior cavity of the first end 141 of outer shaft 102 is further formed with a fifteenth interior screw thread 155. The outer surface of the ninth cylindrical plug 149 is formed with a fourteenth exterior screw 154 that is sized to connect to the fifteenth interior screw thread 155. To assemble the enhanced shaft 101, the third end 143 of the inner shaft 103 is inserted into the second end 142 of the outer shaft 102. The compression spring 104 is then inserted into the first end 141 of the outer shaft 102. Finally, the handle 105 is attached to the outer shaft 102 by screwing the ninth cylindrical plug 149 into the first end 141 of the outer shaft 102. As shown most clearly in FIG. 3, the lengths 134 of the outer shaft 102, inner shaft 103, handle 105, and the ninth cylindrical plug 149 are selected such that a chamber is formed with the enhanced shaft 101 that is sized so that the when the compression spring 104 is completely relaxed the fifth end 145 of the compression spring 104 is in contact with the ninth cylindrical plug 149 and the eighth end 148 of the handle 105 and the sixth end 146 of the compression spring 104 is in contact with the third end 143 of the inner shaft 103.

The handle 105 is further covered in a padded grip 106 for comfort. Optionally, a plunging grip 107 can be added to the handle 105. The purpose of the plunging grip 107 it to provide the user with a handhold for use in sliding the outer shaft 102 up and down over the inner shaft 103.

To use the invention 100, the tool 131 head is attached to the enhanced shaft 101 using the enth threaded connection 150. The invention 100 is used normally. While the invention 100 is being used to create impacts, the reaction of the compression spring 104 absorbs random reverberations that can be created by impacts which increases the control over the invention 100 during use.

The outer shaft 102 and inner shaft 103 may be formed of wood, fiberglass, molded heavy duty plastic or metal piping. The handle 105 may be formed of fiberglass, molded heavy duty plastic or metal piping. In the first potential embodiment of the disclosure, the compression spring 104 is made from 2 commercially available 0.625 inch OD compression springs each with a 1.5" free length 134 that compress with a spring rate of 370 pounds per inch. The commercially available springs are inserted into the outer shaft 102 cavity end to end, much like inserting batteries in a flashlight. The grip 106 and plunging grip 107 are readily and commercially available.

The following definitions were used in this disclosure:

Exterior Screw Thread: As used in this disclosure, an exterior screw thread is a ridge wrapped around the outer surface of a cylinder in the form of a helical structure that is used to convert rotational movement into linear movement.

Interior Screw Thread: As used in this disclosure, an interior screw thread is a ridge wrapped around the inner surface of a cylinder in the form of a helical structure that is used to convert rotational movement into linear movement.

Shaft: As used in this disclosure, the term shaft is used to describe a rigid cylinder that is often used as the handle of a tool or implement. In this disclosure, the terms inner diameter of the shaft and outer diameter of the shaft are used as they would be used by those skilled in the plumbing arts. The definition of shaft explicitly includes solid shafts or shafts that are formed more like pipes with a hollow passage through the shaft that runs along the center axis of the shaft cylinder.

Threaded Connection. As used in this disclosure, a threaded connection is a method of fastening a first object to a second object such that: 1) the first object is formed or fitted with an interior screw thread; 2) the second object is formed or fitted with an exterior screw thread; and, 3) the exterior screw thread is sized and designed to fit within the exterior screw thread.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A spring loaded device comprising:

an enhanced shaft;

wherein the spring loaded device is adapted for use with an impact tool;

wherein the enhanced shaft attaches to the impact tool using a threaded connection;

wherein the enhanced shaft further comprises an outer shaft, an inner shaft, a compression spring, a handle, and the threaded connection;

wherein the outer shaft is a hollow cylindrical device that is further defined with a first end and a second end;

wherein the inner shaft is a solid cylindrical device that is further defined with a third end and a fourth end;

wherein the compression spring is one or more helical coil springs;

wherein the compression spring is further defined with a fifth end and a sixth end;

wherein the outer diameter of the inner shaft is sized so that it will fit inside the inner diameter of the outer shaft;

wherein the outer diameter of the compression spring is less than the inner diameter of the outer shaft;

wherein the handle is further defined with a seventh end and an eighth end;

wherein the handle has fitted on it a ninth cylindrical plug that projects perpendicularly away from the eighth end;

wherein the ninth cylindrical plug is formed with a fourteenth exterior screw thread;

wherein the second end of the outer shaft is formed with a thirteenth interior screw thread;

wherein the outer diameter of the ninth cylindrical plug is sized to fit within the inner diameter of the outer shaft;

wherein the fourth end of the inner shaft further comprises threaded connection;

wherein the threaded connection further comprises a twelfth interior screw thread and an eleventh screw thread.

2. The spring loaded device according to claim 1 wherein the fourth end of the inner shaft is formed with a cavity that has the twelfth interior screw thread formed within the cavity.

3. The spring loaded device according to claim 2 wherein the tool that the enhanced shaft is to be connected to has associated with it the eleventh exterior screw thread.

4. The spring loaded device according to claim 3 wherein the twelfth interior screw thread is adapted to connect to the eleventh exterior screw thread thereby forming the threaded connection between the tool and the enhanced shaft.

5. The spring loaded device according to claim 4 wherein the third end of the inner shaft is inserted into the second end of the outer shaft;

wherein the compression spring is then inserted into the first end of the outer shaft;

wherein the handle is attached to the outer shaft by screwing the ninth cylindrical plug into the first end of the outer shaft.

6. The spring loaded device according to claim 5 wherein the respective lengths of the outer shaft, inner shaft, handle, and the ninth cylindrical plug are selected such that a chamber is formed with the enhanced shaft;

wherein the chamber that is formed with the enhanced shaft is sized so that the when the compression spring is completely relaxed the fifth end of the compression spring is in contact with the ninth cylindrical plug and the eighth end of the handle and the sixth end of the compression spring is in contact with the third end of the inner shaft.

7. The spring loaded device according to claim 6 wherein the handle further comprises a padded grip.

8. The spring loaded device according to claim 6 wherein the handle further comprises a plunging grip.

* * * * *